US008486871B2

(12) United States Patent
Nagao et al.

(10) Patent No.: US 8,486,871 B2
(45) Date of Patent: Jul. 16, 2013

(54) LUBRICANT FOR COMPRESSION TYPE REFRIGERATING MACHINE AND REFRIGERATION SYSTEM USING THE SAME

(75) Inventors: Satoshi Nagao, Chiba (JP); Izumi Terada, Chiba (JP); Nobuaki Shimizu, Chiba (JP); Masato Kaneko, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 485 days.

(21) Appl. No.: 12/529,923

(22) PCT Filed: Mar. 4, 2008

(86) PCT No.: PCT/JP2008/053846

§ 371 (c)(1),
(2), (4) Date: Feb. 19, 2010

(87) PCT Pub. No.: WO2008/108365

PCT Pub. Date: Sep. 12, 2008

(65) Prior Publication Data

US 2010/0139311 A1 Jun. 10, 2010

(30) Foreign Application Priority Data

Mar. 8, 2007 (JP) ..... 2007-059265

(51) Int. Cl.
*C10M 169/04* (2006.01)
*C10L 1/18* (2006.01)
*C08G 63/00* (2006.01)

(52) U.S. Cl.
USPC ..... 508/110; 508/492; 508/494

(58) Field of Classification Search
USPC ..... 508/110, 492, 494
See application file for complete search history.

(56) References Cited

U.S. PATENT DOCUMENTS

| | | | |
|---|---|---|---|
| 2,748,170 | A | 5/1956 | George J. Benoit, Jr. et al. |
| 3,323,942 | A | 6/1967 | John D. Calfee et al. |
| 5,399,631 | A | 3/1995 | Egawa et al. |
| 5,449,472 | A | 9/1995 | Egawa et al. |
| 5,518,643 | A | 5/1996 | Egawa et al. |
| 5,523,491 | A | 6/1996 | Egawa et al. |

(Continued)

FOREIGN PATENT DOCUMENTS

| | | |
|---|---|---|
| EP | 0 644 175 A1 | 3/1995 |
| EP | 1 167 495 A1 | 1/2002 |

(Continued)

OTHER PUBLICATIONS

U.S. Appl. No. 13/026,689, filed Feb. 14, 2011, Kaneko.

(Continued)

*Primary Examiner* — James Goloboy
*Assistant Examiner* — Francis C Campanell
(74) *Attorney, Agent, or Firm* — Oblon, Spivak, McClelland, Maier & Neustadt, L.L.P.

(57) ABSTRACT

A lubricating oil for a compression-type refrigerator using a hydrofluorocarbon refrigerant including a polyvinyl ether-based compound containing in the molecule an alkylene glycol unit or a polyoxyalkylene glycol unit and a polyvinyl ether unit and having a molecular weight in the range of 300 to 3,000, and a refrigeration apparatus using the lubricating oil.

The present invention can provide a lubricating oil for a compression-type refrigerator having good compatibility in the atmosphere of a hydrofluorocarbon and a high viscosity index, and a refrigeration apparatus using such a lubricating oil.

8 Claims, 1 Drawing Sheet

U.S. PATENT DOCUMENTS

| | | | | |
|---|---|---|---|---|
| 5,589,597 | A | 12/1996 | Egawa et al. | |
| 5,616,812 | A | 4/1997 | Egawa et al. | |
| 5,908,818 | A * | 6/1999 | Egawa et al. | 508/579 |
| 6,734,151 | B1 | 5/2004 | Kubota et al. | |
| 6,878,677 | B1 * | 4/2005 | Sakanoue et al. | 508/433 |
| 7,927,503 | B2 * | 4/2011 | Nagao et al. | 252/68 |
| 2003/0199401 | A1 * | 10/2003 | Tazaki | 508/579 |
| 2009/0000331 | A1 * | 1/2009 | Nagao et al. | 62/498 |
| 2010/0132397 | A1 | 6/2010 | Kaneko et al. | |
| 2010/0139311 | A1 * | 6/2010 | Nagao et al. | 62/468 |

FOREIGN PATENT DOCUMENTS

| | | | |
|---|---|---|---|
| EP | 1 227 108 | A1 | 7/2002 |
| EP | 2 071 011 | A1 | 6/2009 |
| GB | 958893 | | 5/1964 |
| JP | 2 305893 | | 12/1990 |
| JP | 6 128578 | | 5/1994 |
| JP | 6-240278 | A | 8/1994 |
| JP | 6-240279 | A | 8/1994 |
| JP | 10 147682 | | 6/1998 |
| JP | 2000 256692 | | 9/2000 |
| JP | 2000 282076 | | 10/2000 |
| JP | 2006 503961 | | 2/2006 |
| WO | WO 93/24435 | A1 | 12/1993 |
| WO | WO 95/15367 | A1 | 6/1995 |
| WO | WO 96/11246 | A1 | 4/1996 |
| WO | WO 00/53704 | A1 | 9/2000 |
| WO | 01 19875 | | 3/2001 |

OTHER PUBLICATIONS

Extended Search Report issued Apr. 5, 2011 in International Application No. 08721266.8.

Office Action issued Jan. 22, 2013, in Japanese Patent Application No. 2009-502586.

* cited by examiner

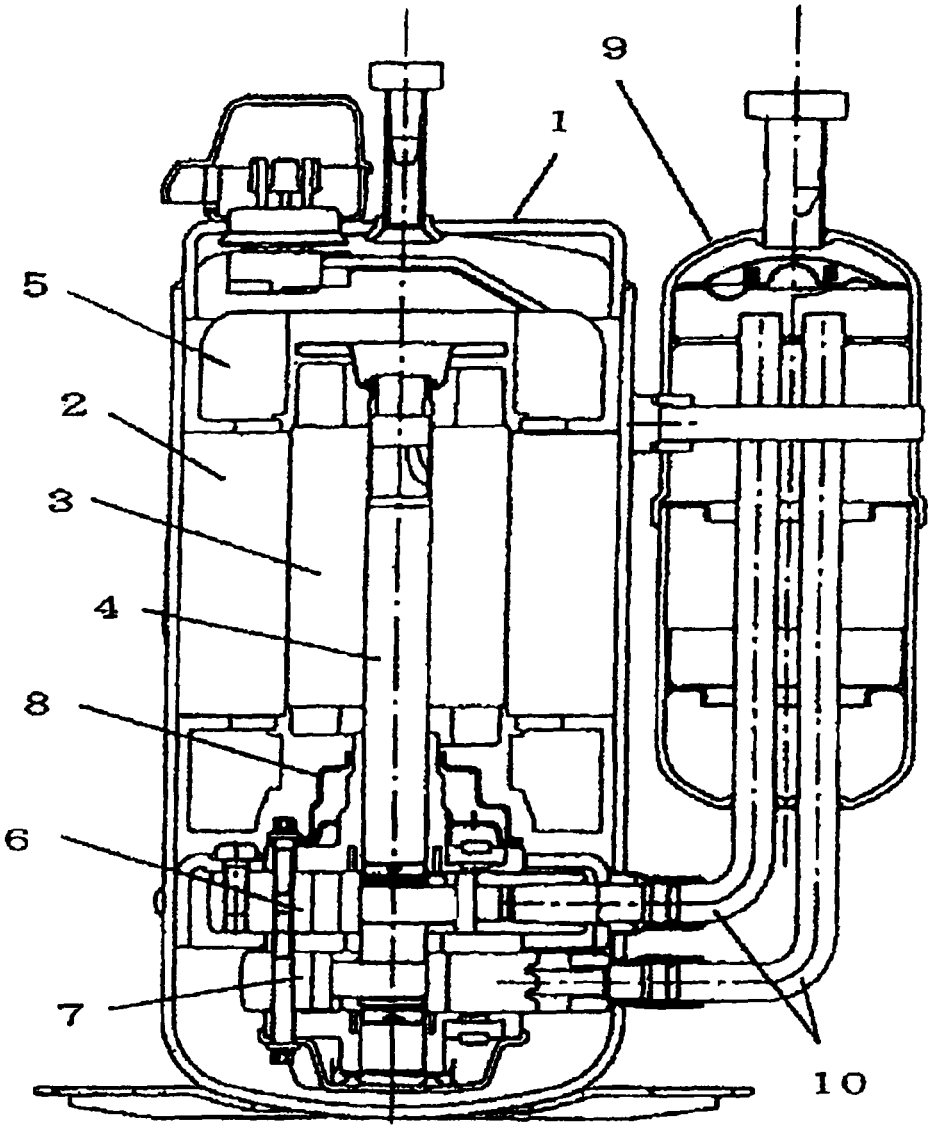
9
1
5
2
3
4
8
6
7
10

LUBRICANT FOR COMPRESSION TYPE REFRIGERATING MACHINE AND REFRIGERATION SYSTEM USING THE SAME

TECHNICAL FIELD

The present invention relates to a lubricating oil for a compression-type refrigerator and, more specifically, to a lubricating oil for a compression-type refrigerator using a hydrofluorocarbon refrigerant and to a refrigeration apparatus using same.

BACKGROUND ART

A compression-type refrigerator is generally comprised of at least a compressor, a condenser, an expansion mechanism (such as an expansion valve) and an evaporator or comprised additionally of a dryer, and is constructed such that a mixed liquid composed of a refrigerant and a lubricating oil (refrigerator oil) is circulated through a closed system including these devices. In such a compression-type refrigerator, in general, a high temperature is established within a compressor while a low temperature is established within a cooler, though depending upon the devices used. Therefore, it is necessary that the refrigerant and the lubricating oil can be circulated through the system without causing a phase separation in a wide temperature range encompassing from the low temperature to the high temperature. In general, the refrigerant and lubricating oil have temperature regions on a low temperature side and on a high temperature side in which regions they cause phase separation. The highest temperature in the low temperature side separation region is preferably −10° C. or lower, particularly preferably −20° C. or lower. On the other hand, the lowest temperature in the high temperature side separation region is preferably 30° C. or higher, particularly preferably 40° C. or higher. Phase separation during the operation of the refrigerator considerably adversely affects the service life and the operation efficiency of the apparatus. For example, if phase separation between the refrigerant and lubricating oil occurs in the compressor section, lubricity in a moving part will become insufficient so that seizing and other problems will occur to considerably reduce the service life of the apparatus. On the other hand, if phase separation occurs in the evaporator, the heat exchange efficiency is considerably reduced because of the presence of a highly viscous lubricating oil.

As a refrigerant for refrigerators, a chlorofluorocarbon (CFC), a hydrochlorofluorocarbon (HCFC), etc. have been hitherto mainly used. Because these compounds contain chlorine atoms which cause environmental problems, chlorine-free refrigerants such as a hydrofluorocarbon (HFC) have been investigated. Thus, hydrofluorocarbons which are saturated fluorinated hydrocarbon compounds, typically 1,1,1,2-tetrafluoroethane, difluoromethane, pentafluoroethane, 1,1,1-trifluoroethane (which are referred to as R134a, R32, R125 and R143a, respectively) have become a focus of attention. For example, R134a is actually used in a car air conditioning system. Further, as an HFC refrigerant that has a lower global warming coefficient as compared with the above HFCs and that can be employed in the current car air conditioning system, there has been found a hydrofluorocarbon refrigerant (see, for example, Patent Document 1) which is an unsaturated fluorinated hydrocarbon.

As a main lubricating oil for use in a refrigerator using an HFC refrigerant, polyvinyl ether (PVE) and a polyalkylene glycol (PAG) are known (see, for example, Patent Document 2 and Patent Document 3). There is, however, room for further improving these lubricating oils with respect to compatibility with the refrigerant.

[Patent Document 1] Japanese Translation of PCT International Application Publication No. 2006-503961

[Patent Document 2] Japanese Unexamined Patent Application Publication No. H06-128578

[Patent Document 3] Japanese Unexamined Patent Application Publication No. H02-305893

DISCLOSURE OF THE INVENTION

Problem to be Solved by the Invention

The present invention has been made in view of the above-described circumstance and has as its object the provision of a lubricating oil for a compression-type refrigerator having good compatibility in the atmosphere of a hydrofluorocarbon and a high viscosity index, and of a refrigeration apparatus using such a lubricating oil.

Means for Solving the Problem

The present inventors have made an earnest study with a view toward developing a lubricating oil for a compression-type refrigerator having the above-described desired properties and have found that the above problem can be solved by a lubricating oil containing as its main ingredient an ether-based compound having a specific structure.

Thus, the present invention provides:

(1) A lubricating oil for a compression-type refrigerator using a hydrofluorocarbon refrigerant, comprising a polyvinyl ether-based compound containing in the molecule an alkylene glycol unit or a polyoxyalkylene glycol unit and a polyvinyl ether unit and having a molecular weight in the range of 300 to 3,000;

(2) A lubricating oil for a compression-type refrigerator using a hydrofluorocarbon refrigerant, comprising a polyvinyl ether-based compound obtained by polymerizing a vinyl ether-based compound in the presence of a polymerization initiator and having a molecular weight in the range of 300 to 3,000, wherein at least one of the polymerization initiator and the vinyl ether-based compound contains an alkylene glycol residue or a polyoxyalkylene glycol residue; and (3) A refrigeration apparatus comprising a system for circulating a hydrofluorocarbon refrigerant including at least a compressor, a condenser, an expansion mechanism and an evaporator, said apparatus using a hydrofluorocarbon refrigerant and a lubricating oil for a compression-type refrigerator as defined in (1) or (2) above.

Effect of the Invention

According to the present invention, there can be provided a lubricating oil for a compression-type refrigerator having good compatibility in the atmosphere of a hydrofluorocarbon and a high viscosity index, and a refrigeration apparatus using such a lubricating oil.

BRIEF DESCRIPTION OF DRAWINGS

FIG. 1 is a vertical cross-sectional view showing an essential part of an example of a compression-type refrigerator of a refrigeration apparatus according to the present invention.

DESCRIPTION OF REFERENCE NUMERALS

1: casing
2: stator
3: motor roller
4: rotary shaft
5: winding section
6: upper compression chamber
7: lower compression chamber
8: muffler
9: accumulator
10: suction pipe

BEST MODE FOR CARRYING OUT THE INVENTION

A lubricating oil for a compression-type refrigerator of the present invention (hereinafter occasionally referred to simply as lubricating oil) has two embodiments; namely (1) a lubricating oil (I) characterized by comprising a polyvinyl ether-based compound which contains in the molecule an alkylene glycol unit or a polyoxyalkylene glycol unit and a polyvinyl ether unit and which has a molecular weight in the range of 300 to 3,000, and (2) a lubricating oil (II) characterized by comprising a polyvinyl ether-based compound which is obtained by polymerizing a vinyl ether-based compound in the presence of a polymerization initiator and which has a molecular weight in the range of 300 to 3,000, at least one of the polymerization initiator and the vinyl ether-based compound containing an alkylene glycol residue or a polyoxyalkylene glycol residue.

As the lubricating oil which falls within the scope of lubricating oils (I) and (II) of the present invention, there may be mentioned lubricating oils containing one of polyvinyl ether-based compounds (1) to (4).

Polyvinyl Ether-Based Compound (1):

Polyvinyl ether-based compound (1) is an ether-based compound having a constituting unit represented by the following general formula (I).

[Chemical Formula 1]

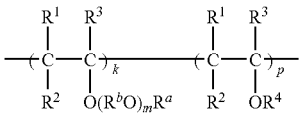

(I)

In the general formula (I), $R^1$, $R^2$ and $R^3$ each represent a hydrogen atom or a $C_1$ to $C_8$ hydrocarbon group and may be the same as or different from each other, $R^b$ represents a divalent $C_2$ to $C_4$ hydrocarbon group, $R^a$ represents a hydrogen atom, a $C_1$ to $C_{20}$ aliphatic or alicyclic hydrocarbon group, a $C_1$ to $C_{20}$ aromatic group which may have a substituent, a $C_2$ to $C_{20}$ acyl group or a $C_2$ to $C_{50}$ oxygen-containing hydrocarbon group, $R^4$ represents a $C_1$ to $C_{10}$ hydrocarbon group, with the proviso that when there are a plurality of $R^a$'s, a plurality of $R^b$'s and a plurality of $R^4$'s, the $R^a$'s, $R^b$'s and $R^4$'s may each be the same as or different from each other, m is a number of 1 to 50 on average, k is a number of 1 to 50 on average, and p is a number of 0 to 50 on average, with the provisos that when there are a plurality of k's and a plurality of p's, the distribution may each be block or random, and that when there are a plurality of $R^bO$'s, the $R^bO$'s may be the same as or different from each other.

Specific examples of the $C_1$ to $C_8$ hydrocarbon group represented by $R^1$ to $R^3$ include alkyl groups such as a methyl group, an ethyl group, an n-propyl group, an isopropyl group, an n-butyl group, an isobutyl group, a sec-butyl group, a tert-butyl group, the various pentyl groups, the various hexyl groups, the various heptyl groups and the various octyl groups; cycloalkyl groups such as a cyclopentyl group, a cyclohexyl group, the various methylcyclohexyl groups, the various ethylcyclohexyl groups and the various dimethylcyclohexyl groups; aryl groups such as a phenyl group, the various methylphenyl groups, the various ethylphenyl groups and the various dimethylphenyl groups; and arylalkyl groups such as a benzyl group, the various phenylethyl groups and the various methylbenzyl groups. Each of $R^1$, $R^2$ and $R^3$ is particularly preferably a hydrogen atom.

Specific examples of the divalent $C_2$ to $C_4$ hydrocarbon group represented by $R^b$ include divalent alkylene groups such as a methylene group, an ethylene group, a propylene group, a trimethylene group and the various butylene groups.

In the general formula (I), m is a repeating number of $R^bO$ and is, on average, in the range of 1 to 50, preferably 2 to 20, more preferably 2 to 10, particularly preferably 2 to 5. When there are a plurality of $R^bO$'s, the plural $R^bO$'s may be the same as or different from each other.

The symbol k is a number of 1 to 50, preferably 1 to 10, more preferably 1 to 2, particularly preferably 1. The symbol p is a number of 0 to 50, preferably 2 to 25, more preferably 5 to 15. When there are a plurality of k's and a plurality of p's, the distribution may be block or random.

The $C_1$ to $C_{20}$ aliphatic or alicyclic hydrocarbon group represented by $R^a$ is preferably a $C_1$ to $C_{10}$ alkyl group or $C_5$ to $C_{10}$ cycloalkyl group and is more particularly a methyl group, an ethyl group, an n-propyl group, an isopropyl group, an n-butyl group, an isobutyl group, a sec-butyl group, a tert-butyl group, the various pentyl groups, the various hexyl groups, the various heptyl groups, the various octyl groups, the various nonyl groups, the various decyl groups, a cyclopentyl group, a cyclohexyl group, the various methylcyclohexyl groups, the various ethylcyclohexyl groups, the various propylcyclohexyl groups and the various dimethylcyclohexyl groups.

As the $C_1$ to $C_{20}$ aromatic group, represented by $R^a$, which may have a substituent, there may be specifically mentioned an aryl group such as a phenyl group, the various tolyl groups, the various ethylphenyl groups, the various xylyl groups, the various trimethylphenyl groups, the various butylphenyl groups and the various naphthyl groups; and an arylalkyl group such as a benzyl group, the various phenylethyl groups, the various methylbenzyl groups, the various phenylpropyl groups and the various phenylbutyl groups.

As the $C_2$ to $C_{20}$ acyl group represented by $R^a$, there may be mentioned an acetyl group, a propionyl group, a butyryl group, an isobutyryl group, a valeryl group, an isovaleryl group, a pivaloyl group, a benzoyl group and a toluoyl group.

Further, as the preferred $C_2$ to $C_{50}$ oxygen-containing hydrocarbon group represented by $R^a$, there may be specifically mentioned, for example, a methoxymethyl group, a methoxyethyl group, a methoxypropyl group, a 1,1-bismethoxypropyl group, a 1,2-bismethoxypropyl group, an ethoxypropyl group, a (2-methoxyethoxy)propyl group and a (1-methyl-2-methoxy)propyl group.

Specific examples of $C_1$ to $C_{10}$ hydrocarbon group represented by $R^4$ in the general formula (I) include alkyl groups such as a methyl group, an ethyl group, an n-propyl group, an isopropyl group, an n-butyl group, an isobutyl group, the various pentyl groups, the various hexyl groups, the various heptyl groups, the various octyl groups, the various nonyl groups and the various decyl groups; cycloalkyl groups such as a cyclopentyl group, a cyclohexyl group, the various methylcyclohexyl groups, the various ethylcyclohexyl groups, the various propylcyclohexyl groups and the various dimethylcyclohexyl groups; aryl groups such as a phenyl group, the various methylphenyl groups, the various ethylphenyl groups, the various dimethylphenyl groups, the various propylphenyl groups, the various trimethylphenyl groups, the various butylphenyl groups and the various naphthyl groups; and arylalkyl groups such as a benzyl group, the various phenylethyl groups, the various methylbenzyl groups, the various phenylpropyl groups and the various phenylbutyl groups.

Incidentally, $R^1$ to $R^3$, $R^a$, $R^b$, m and $R^1$ to $R^4$ may each be the same as or different from each other among the constituting units.

The polyvinyl ether-based compound (1) may be obtained by, for example, polymerizing a vinyl ether compound represented by the general formula (VII) using as an initiator an alkylene glycol compound or a polyoxyalkylene glycol compound represented by the general formula (VI).

[Chemical Formula 2]

$$R^a—(OR^b)_m—OH \quad (VI)$$

[Chemical Formula 3]

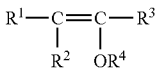

(VII)

In the above formulas $R^a$, $R^b$, m and $R^1$ to $R^4$ are as defined above.

Specific examples of the alkylene glycol compound and polyoxyalkylene glycol compound include alkylene glycols, polyoxyalkylene glycols and monoether compounds thereof, such as ethylene glycol, ethylene glycol monomethyl ether, diethylene glycol, diethylene glycol monomethyl ether, triethylene glycol, triethylene glycol monomethyl ether, propylene glycol, propylene glycol monomethyl ether, dipropylene glycol, dipropylene glycol monomethyl ether, tripropylene glycol and tripropylene glycol monomethyl ether.

As the vinyl ether-based compound represented by the general formula (VII), there may be mentioned vinyl ethers such as vinyl methyl ether, vinyl ethyl ether, vinyl n-propyl ether, vinyl isopropyl ether, vinyl n-butyl ether, vinyl isobutyl ether, vinyl sec-butyl ether, vinyl tert-butyl ether, vinyl n-pentyl ether and vinyl n-hexyl ether; propenes such as 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene and 2-tert-butoxypropene; and butenes such as 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene and 2-tert-butoxy-2-butene. These vinyl ether-based monomers may be prepared by any conventional method.

Polyvinyl Ether-Based Compound (2):

Polyvinyl ether-based compound (2) is an ether-based compound having a structure represented by the following general formula (II).

$$R^c—[[(OR^d)_a-(A)_b-(OR^f)_e]_c—R^e]_d \quad (II)$$

In the general formula (II), $R^c$ represents a hydrogen atom, a $C_1$ to $C_{10}$ alkyl group, a $C_2$ to $C_{10}$ acyl group or a $C_1$ to $C_{10}$ hydrocarbon group having 2 to 6 bonding sites; $R^d$ and $R^f$ each represent a $C_2$ to $C_4$ alkylene group; a and e are each a number of 0 to 50 on average; c is an integer of 1 to 20; $R^e$ represents a hydrogen atom, a $C_1$ to $C_{10}$ alkyl group, a $C_1$ to $C_{10}$ alkoxy group or a $C_2$ to $C_{10}$ acyl group, with the proviso that when a and/or e are two or more, $(OR^d)$ and/or $(OR^f)$ and (A) may each be distributed randomly or in a block form.

(A) represents a group expressed by the general formula (III):

[Chemical Formula 4]

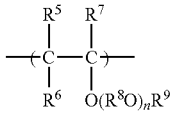

(III)

wherein $R^5$, $R^6$ and $R^7$ each represent a hydrogen atom or a $C_1$ to $C_8$ hydrocarbon group and may be the same as or different from each other, $R^8$ represents a divalent $C_1$ to $C_{10}$ hydrocarbon group or a divalent $C_2$ to $C_{20}$ ethereal oxygen-containing hydrocarbon group, $R^9$ represents a hydrogen atom, a $C_1$ to $C_{20}$ hydrocarbon group, and n is a number of 0 to 10 on average, with the provisos that when there are a plurality of n's, the n's may be the same as or different from each other among the constituting units, that $R^5$ to $R^9$ may be the same as or different from each other among the constituting units, and that when there are a plurality of $R^8O$'s, the $R^8O$'s may be the same as or different from each other; b is an integer of 3 or more; and d is an integer of 1 to 6, with the proviso that when a is 0, n of any one of the constituting units A's is an integer of 1 or more.

As the $C_1$ to $C_{10}$ alkyl group represented by $R^c$ and $R^e$, there may be mentioned, for example, alkyl groups such as a methyl group, an ethyl group, an n-propyl group, an isopropyl group, an n-butyl group, an isobutyl group, the various pentyl groups, the various hexyl groups, the various heptyl groups, the various octyl groups, the various nonyl groups and the various decyl groups; a cyclopentyl group, a cyclohexyl group, the various methylcyclohexyl groups, the various ethylcyclohexyl groups, the various propylcyclohexyl groups and the various dimethylcyclohexyl groups. As $C_2$ to $C_{10}$ acyl group represented by $R^c$ and $R^e$, there may be mentioned, for example, an acetyl group, a propionyl group, a butyryl group, an isobutyryl group, a valeryl group, an isovaleryl group, a pivaloyl group, a benzoyl group and a toluoyl group.

As the $C_1$ to $C_{10}$ alkoxy group represented by $R^e$, there may be mentioned, for example, a methoxy group, an ethoxy group, a propoxy group, a butoxy group, a pentyloxy group, a hexyloxy group, a heptyloxy group, an octyloxy group, a nonyloxy group and a decyloxy group.

As the $C_1$ to $C_{10}$ hydrocarbon group with 2 to 6 bonding sites, which is represented by $R^c$, there may be mentioned residues obtained by removing hydroxyl groups from polyhydric alcohols such as ethylene glycol, diethylene glycol, propylene glycol, dipropylene glycol, polypropylene glycol, neopentyl glycol, trimethylolethane, trimethylolpropane, glycerin, ditrimethylolpropane, diglycerin, pentaerythritol, dipentaerythritol and sorbitol.

As the $C_2$ to $C_4$ alkylene group represented by $R^d$, there may be mentioned, for example, an ethylene group, a propylene group, a trimethylene group and the various butylene groups.

Specific examples of the $C_1$ to $C_8$ hydrocarbon group represented by $R^5$ to $R^7$ in the general formula (III) include alkyl groups such as a methyl group, an ethyl group, an n-propyl group, an isopropyl group, an n-butyl group, an isobutyl group, the various pentyl groups, the various hexyl groups, the various heptyl groups and the various octyl groups; cycloalkyl groups such as a cyclopentyl group, a cyclohexyl group, the various methylcyclohexyl groups, the various ethylcyclohexyl groups and the various dimethylcyclohexyl groups; aryl groups such as a phenyl group, the various methylphenyl groups, the various ethylphenyl groups and the various dimethylphenyl groups; and arylalkyl groups such as a benzyl group, the various phenylethyl groups and the various methylbenzyl groups. Each of $R^5$, $R^6$ and $R^7$ is particularly preferably a hydrogen atom.

Specific examples of the divalent $C_1$ to $C_{10}$ hydrocarbon group represented by $R^8$ include a divalent aliphatic group such as a methylene group, an ethylene group, a phenylethylene group, a 1,2-propylene group, a 2-phenyl-1,2-propylene group, 1,3-propylene group, the various butylene groups, the various pentylene groups, the various hexylene groups, the various heptylene groups, the various octylene groups, the various nonylene groups and the various decylene groups; an alicyclic group with two bonding sites which is derived from an alicyclic hydrocarbon such as cyclohexane, methylcyclohexane, ethylcyclohexane, dimethylcyclohexane and propylcyclohexane; a divalent aromatic hydrocarbon group such as the various phenylene groups, the various methylphenylene groups, the various ethylphenylene groups, the various dimethylphenylene groups and the various naphthylene groups; an alkylaromatic group which has a monovalent bonding site in each of the alkyl moiety and aromatic moiety thereof and which is derived from an alkylaromatic hydrocarbon such as toluene, xylene and ethylbenzene; and an alkylaromatic group which has bonding sites in the alkyl moieties thereof and which is derived from a polyalkylaromatic hydrocarbon such as xylene and diethylbenzene. Above all, $C_2$ to $C_4$ aliphatic groups are particularly preferred.

As the preferred divalent $C_2$ to $C_{20}$ ethereal oxygen-containing hydrocarbon group represented by $R^8$, there may be mentioned, for example, a methoxymethylene group, a methoxyethylene group, a methoxymethylethylene group, a 1,1-bismethoxymethylethylene group, a 1,2-bismethoxymethylethylene group, an ethoxymethylethylene group, a (2-methoxyethoxy)methylethylene group, and a (1-methyl-2-methoxy)methylethylene group.

Specific examples of the $C_1$ to $C_{20}$ hydrocarbon group represented by $R^9$ include alkyl groups such as a methyl group, an ethyl group, an n-propyl group, an isopropyl group, an n-butyl group, an isobutyl group, a sec-butyl group, a tert-butyl group, the various pentyl groups, the various hexyl groups, the various heptyl groups, the various octyl groups, the various nonyl groups and the various decyl groups; cycloalkyl groups such as a cyclopentyl group, a cyclohexyl group, the various methylcyclohexyl groups, the various ethylcyclohexyl groups, the various propylcyclohexyl groups and the various dimethylcyclohexyl groups; aryl groups such as a phenyl group, the various methylphenyl groups, the various ethylphenyl groups, the various dimethylphenyl groups, the various propylphenyl groups and the various trimethylphenyl groups, the various butylphenyl groups and the various naphthyl groups; and arylalkyl groups such as a benzyl group, the various phenylethyl groups, the various methylbenzyl groups, the various phenylpropyl groups and the various phenylbutyl groups.

The polyvinyl ether-based compound (2) represented by the above general formula (II) is preferably a compound in which $R^c$ is a hydrogen atom, a=0, c=1 and d=1, a compound in which $R^e$ is a hydrogen atom, e=0 and c=1, or a compound which satisfies both of the above conditions, from the standpoint of properties as a lubricating oil.

Also preferred is a compound in which $R^5$ to $R^7$ of (A) are each a hydrogen atom, n is a number of 0 to 4 on average with any one of n's being 1 or more, and $R^8$ is a $C_2$ to $C_4$ hydrocarbon group.

Polyvinyl Ether-Based Compound (3):

Polyvinyl ether-based compound (3) is an ether-based compound having a structure represented by the following general formula (IV):

$$R^c—[(OR^d)_a\text{-}(A)_b\text{-}(OR^f)_e]_d—R^g \quad \text{(IV)}$$

In the general formula (IV), $R^c$, $R^d$, A, a, b, d and e have the same meaning as defined for the general formula (II), $R^g$ represents a hydrogen atom, a $C_1$ to $C_{10}$ alkyl group, a $C_1$ to $C_{10}$ alkoxy group, a $C_2$ to $C_{10}$ acyl group or a $C_1$ to $C_{10}$ hydrocarbon group having 2 to 6 bonding sites, with the provisos that when a and/or e are 2 or more, $OR^d$ and/or $OR^f$ and A may each be distributed randomly or in a block form and that when a and e are both 0, n of any one of the constituting units A's is an integer of 1 or more.

As the $C_2$ to $C_4$ alkylene group represented by $R^f$, there may be mentioned, for example, an ethylene group, a propylene group, a trimethylene group and the various butylene groups.

As the $C_1$ to $C_{10}$ alkyl group, $C_2$ to $C_{10}$ acyl group and $C_1$ to $C_{10}$ hydrocarbon group with 2 to 6 bonding sites, which are represented by $R^g$, there may be mentioned the same groups as those exemplified for $R^g$ of the above general formula (II).

As the $C_1$ to $C_{10}$ alkoxy group represented by $R^g$, there may be mentioned the same groups as those exemplified for $R^e$ of the above general formula (II).

The polyvinyl ether-based compound (3) represented by the above general formula (IV) is preferably a compound in which $R^c$ is a hydrogen atom and a=0, a compound in which $R^g$ is a hydrogen atom, d=1 and e=0, or a compound which satisfies both of the above conditions.

Also preferred is a compound in which $R^5$ to $R^7$ of (A) are each a hydrogen atom, n is a number of 0 to 4 on average with any one of n's being 1 or more, and $R^8$ is a $C_2$ to $C_4$ hydrocarbon group.

Polyvinyl Ether-Based Compound (4):

Polyvinyl ether-based compound (4) is a block or random copolymer having a constituting unit (a) represented by the above general formula (III) and a constituting unit (b) represented by the general formula (V):

[Chemical Formula 5]

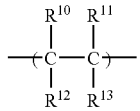

(V)

wherein $R^{10}$ to $R^{13}$ each represent a hydrogen atom or a $C_1$ to $C_{20}$ hydrocarbon group and may be the same as or different from each other, with the proviso that $R^{10}$ to $R^{13}$ may be the same as or different from each other among the constituting units.

As the $C_1$ to $C_{20}$ hydrocarbon group represented by $R^{10}$ to $R^{13}$ in the general formula (V), there may be mentioned the same groups as those exemplified for $R^9$ of the above general formula (III).

The polyvinyl ether compound (4) may be prepared by, for example, copolymerizing a vinyl ether-based monomer represented by the general formula (VIII)

[Chemical Formula 6]

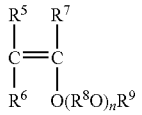

(VIII)

wherein $R^5$ to $R^9$ and n have the same meaning as above, with a hydrocarbon monomer with an olefinic double bond represented by the general formula (IX)

[Chemical Formula 7]

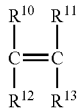

(IX)

wherein $R^{10}$ to $R^{13}$ have the same meaning as above.

As the vinyl ether-based monomer represented by the above general formula (VIII), there may be mentioned vinyl ethers such as vinyl methyl ether, vinyl ethyl ether, vinyl n-propyl ether, vinyl isopropyl ether, vinyl n-butyl ether, vinyl isobutyl ether, vinyl sec-butyl ether, vinyl tert-butyl ether, vinyl n-pentyl ether, vinyl n-hexyl ether, vinyl 2-methoxyethyl ether, vinyl 2-ethoxyethyl ether, vinyl 2-methoxy-1-methylethyl ether, vinyl 2-methoxy-2-methyl ether, vinyl 3,6-dioxaheptyl ether, vinyl 3,6,9-trioxadecyl ether, vinyl 1,4-dimethyl-3,6-dioxaheptyl ether, vinyl 1,4,7-trimethyl-3,6,9-trioxadecyl ether, vinyl 2,6-dioxa-4-heptyl ether, vinyl 2,6,9-trioxa-4-decyl ether; propenes such as 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene and 2-tert-butoxypropene; and butenes such as 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene and 2-tert-butoxy-2-butene. These vinyl ether-based monomers may be prepared by any conventional method.

As the hydrocarbon monomer with an olefinic double bond represented by the above general formula (IX), there may be mentioned, for example, ethylene, propylene, the various butenes, the various pentenes, the various hexanes, the various heptanes, the various octenes, diisobutylene, triisobutylene, styrene and the various alkyl-substituted styrenes.

In the present invention, the vinyl ether-based compounds (1) to (4) may be prepared by, for example, radical polymerization, cationic polymerization or radiation polymerization of the corresponding vinyl ether-based compound and, optionally, a hydrocarbon monomer having an olefinic double bond. In the case of a vinyl ether-based monomer, for example, the following method may be adopted to obtain a polymer having a desired viscosity. For the initiation of the polymerization, a combination of a Bronsted acid, a Lewis acid or an organometallic compound with water, an alcohol, a phenol, an acetal or an addition product of a vinyl ether and a carboxylic acid can be used. As the Bronsted acid, there may be mentioned, for example, hydrofluoric acid, hydrochloric acid, hydrobromic acid, hydroiodic acid, nitric acid, sulfuric acid, trichloroacetic acid and trifluoroacetic acid. As the Lewis acid, there may be mentioned, for example, boron trifluoride, aluminum trichloride, aluminum tribromide, tin tetrachloride, zinc dichloride and ferric chloride. Among these Lewis acids, boron trifluoride is particularly preferred. As the organometallic compound, there may be mentioned, for example, diethyl aluminum chloride, ethyl aluminum chloride and diethyl zinc.

Any of water, an alcohol, a phenol, an acetal or an addition product of a vinyl ether and a carboxylic acid may be arbitrarily selected for combining with the above Bronsted acid, Lewis acid or organometallic compound. As the alcohol, there may be mentioned, for example, $C_1$ to $C_{20}$ saturated aliphatic alcohols such as methanol, ethanol, propanol, isopropanol, butanol, isobutanol, sec-butanol, tert-butanol, the various pentanols, the various hexanols, the various heptanols and the various octanols; $C_3$ to $C_{10}$ unsaturated aliphatic alcohols such as allyl alcohol; and monothers of an alkylene glycol such as ethylene glycol monomethyl ether, diethylene glycol monomethyl ether, triethylene glycol monomethyl ether, propylene glycol monomethyl ether, dipropylene glycol monomethyl ether and tripropylene glycol monomethyl ether. As the carboxylic acid utilized for forming the addition product with a vinyl ether, there may be mentioned, for example, acetic acid, propionic acid, n-butyric acid, isobutyric acid, n-valeric acid, isovaleric acid, 2-methylbutyric acid, pivalic acid, n-caproic acid, 2,2-dimethylbutyric acid, 2-methylvaleric acid, 3-methylvaleric acid, 4-methylvaleric acid, enanthic acid, 2-methylcaproic acid, caprylic acid, 2-ethylcaproic acid, 2-n-propylvaleric acid, n-nonanoic acid, 3,5,5-trimethylcaproic acid, capric acid and undecanoic acid.

In case where an addition product of a vinyl ether and a carboxylic acid is used, the vinyl ether may be the same as or different from that used for the polymerization. The addition product of a vinyl ether and a carboxylic acid can be obtained by mixing these compounds together and reacting the resulting mixture at a temperature around 0 to 100° C. The product may be utilized for the reaction after isolation by, for example, distillation but may also be utilized for the reaction as such without isolation.

When water, an alcohol or a phenol is used, hydrogen is attached to the initiated end of the polymer. When an acetal is used, hydrogen or a group formed by elimination of one of the alkoxy groups from the used acetal is formed at the initiated end. When an addition product of a vinyl ether and a carboxylic acid is used, a group formed by elimination of the alkylcarbonyloxy group derived from the carboxylic acid moiety from the addition product of the vinyl ether and the carboxylic acid is formed at the initiated end.

On the other hand, at the terminated end of the polymer, an acetal, an olefin or an aldehyde is formed when water, an alcohol, a phenol or an acetal is used. When an addition product of a vinyl ether and a carboxylic acid is used, a carboxylic acid ester of hemiacetal is formed at the terminated end of the polymer. The terminal end of the polymer thus obtained may be converted into a desired group by a conventional method. Such a group may be, for example, a residue of a saturated hydrocarbon, an ether, an alcohol, a ketone, a nitrile, an amide, or the like. Among them, saturated hydrocarbon, ether or alcohol residues are preferred.

The polymerization of the vinyl ether-based monomer represented by the general formula (VIII) can be initiated at a temperature between −80° C. and 150° C. and can be generally carried out within a temperature range of −80° C. and 50° C., although the temperatures vary with the kinds of the raw material and the initiator. The polymerization terminates about 10 seconds to 10 hours after the start of the reaction. With regard to the control of the molecular weight in the polymerization, a polymer having a low average molecular weight can be obtained by increasing the amount of the water, alcohol, phenol, acetal or addition product of a vinyl ether and a carboxylic acid relative to the vinyl ether-based monomer represented by the general formula (VIII).

Further, a polymer having a low average molecular weight can be obtained by increasing the amount of the above-described Bronsted acid and Lewis acid. The polymerization is generally carried out in the presence of a solvent. The solvent is not specifically limited as long as it can dissolve the necessary amount of the reaction raw materials and is inert to the reaction. Illustrative of suitable solvents are a hydrocarbon solvent such as hexane, benzene and toluene, and an ether solvent such as ethyl ether, 1,2-dimethoxyethane and tetrahydrofuran. The polymerization reaction may be terminated by addition of an alkali. After the termination of the polymerization, the reaction liquid is subjected to usual separation and purification treatments to obtain the desired polyvinyl ether-based compound.

It is preferred that the polyvinyl ether-based compound to be incorporated into each of the lubricating oil (I) and lubricating oil (II) of the present invention have a carbon/oxygen molar ratio of 4 or less. When the molar ratio exceeds 4, the compatibility of the lubricating oil with a hydrofluorocarbon refrigerant reduces. The molar ratio can be controlled within the above range by controlling a carbon/oxygen molar ratio of the raw material monomer. That is, with an increase of the proportion of the raw material monomer having a high carbon/oxygen molar ratio, the polymer obtained has a higher carbon/oxygen molar ratio. On the other hand, with an increase of the proportion of the raw material monomer having a low carbon/oxygen molar ratio, the polymer obtained has a lower carbon/oxygen molar ratio. It is also possible to vary the carbon/oxygen molar ratio by varying the combination of the monomer with the initiator, namely water, an alcohol, a phenol, an acetal or an addition product of a vinyl ether and a carboxylic acid as described in the method for the polymerization of the above vinyl ether-based monomer. Thus, when an initiator, such as an alcohol and a phenol, having a higher carbon/oxygen molar ratio than that of the monomer to be polymerized is used, a polymer having a higher carbon/oxygen molar ratio than that of the raw material monomer can be obtained. On the other hand, when an initiator, such as methanol and methoxyethanol, having a lower carbon/oxygen molar ratio is used, a polymer having a lower carbon/oxygen molar ratio than that of the raw material monomer can be obtained.

Further, in a case where a vinyl ether-based monomer is copolymerized with a hydrocarbon monomer having an olefinic double bond, a polymer having a higher carbon/oxygen molar ratio as compared with the carbon/oxygen molar ratio of the vinyl ether-based monomer may be obtained. The ratio can be controlled by the amount of the hydrocarbon monomer having an olefinic double bond and by the number of carbon atoms of the hydrocarbon monomer.

The lubricating oil for a compression-type refrigerator of the present invention contains the above-described polyvinyl ether-based compound in an amount of preferably 70% by mass or more, more preferably 80% by mass or more, still more preferably 90% by mass or more, particularly preferably 100% by mass. Only one kind of the polyvinyl ether-based compound may be used. Alternatively, two or more kinds of the polyvinyl ether-based compounds may be used in combination. Any lube base oil may be used in conjunction with the polyvinyl ether-based compound in an amount of less than 30% by mass for obtaining the lubricating oil.

The lubricating oil of the present invention preferably has a kinematic viscosity of 1 to 50 $mm^2/s$, particularly preferably 5 to 25 $mm^2/s$, at 100° C. before being mixed with the refrigerant, and a viscosity index of preferably 80 or more, more preferably 90 or more, still more preferably 100 or more.

Further, the lubricating oil of the present invention preferably has a carbon/oxygen molar ratio of 4 or below, since too high a molar ratio in excess of 4 causes a reduction of compatibility with carbon dioxide.

Further, if desired, the lubricating oil of the present invention may be added with various generally employed additives such as a load withstanding additive, a chlorine scavenger, an antioxidant, a metal deactivator, an antifoaming agent (e.g., silicone), a detergent dispersant, a viscosity index improver, an oiliness agent (e.g., a fatty acid), an antiwear agent (e.g., zinc dithiophosphate), an extreme pressure agent (e.g., a chlorinated paraffin and a sulfur compound), a rust inhibitor, a corrosion inhibitor and a pour point depressant. Specific examples of some of these additives are given below.

Examples of the load withstanding additive include an organic sulfur compound-type additive such as monosulfides, polysulfides, sulfoxides, sulfones, thiosulfinates, sulfurized fats and oils, thiocarbonates, thiophenes, thiazols and methanesulfonates; a phosphate-type additive such as monoesters of phosphoric acid, diesters of phosphoric acid and triesters of phosphoric acid (e.g., tricresyl phosphate); a phosphite-type additive such as monoesters of phosphorous acid, diesters of phosphorous acid and triesters of phosphorous acid; a thiophosphate-type additive such as triesters of thiophosphoric acid; a fatty acid ester-type additive such as higher fatty acids, hydroxyarylfatty acids, esters of carboxylic acid-containing polyhydric alcohol and acrylic acid esters; an organic chlorine-type additive such as chlorinated hydrocarbons and chlorinated carboxylic acid derivatives; an organic fluorine-type additive such as fluorinated aliphatic carboxylic acids, ethylene fluoride resins, fluoroalkyl polysiloxanes and fluorinated graphite; an alcohol-type additive such as higher alcohols; and a metallic compound-type additive such as naphthenic acid salts (e.g., lead naphthenate), fatty acid salts (e.g., a lead salt of a fatty acid), thiophosphoric acid salts (zinc dialkyldithiophosphate), thiocarbamic acid salts, organic molybdenum compounds, organic tin compounds, organic germanium compounds and boric acid esters.

Examples of the chlorine scavenger include compounds having a glycidyl ether group, α-olefin oxides, monoesters of an epoxydized fatty acid, epoxydized fats and oils and compounds having an epoxycycloalkyl group. Examples of the antioxidant include phenols (e.g., 2,6-di-tert-butyl-p-cresol) and aromatic amines (e.g., α-naphthylamine). Examples of the metal deactivator include benzotriazole derivatives.

Examples of the antifoaming agent include silicone oil (e.g., dimethylpolysiloxane) and polymethacrylates. Examples of the detergent dispersant include sulfonates, phenates and succinimides. Examples of the viscosity index improver include polymethacrylate, polyisobutylene, ethylene-propylene copolymers and hydrogenated styrene-diene copolymers.

The compounding amount of these additives is generally about 0.001 to 10% by mass based on a total weight of the lubricating oil.

The lubricating oil of the present invention is suited for use with a hydrofluorocarbon (HFC) refrigerant. The hydrofluorocarbon refrigerant may be a saturated fluorinated hydrocarbon refrigerant or an unsaturated hydrocarbon refrigerant having a double bond.

Typical examples of the saturated fluorinated hydrocarbon include R32 (difluoromethane), R125 (pentafluoroethane), R134a (1,1,1,2-tetrafluoroethane) and R143a (1,1,1-trifluoroethane). A mixed refrigerant composed of two or more of the above refrigerants may also be used. As the mixed refrigerant, there may be mentioned, for example, R404A (a mixture of R125, R143a and R134a), R407A, R407C, R407E (these are mixtures of R32, R125 and R134a), R410A (a mixture of R32 and R125) and R507A (a mixture of R125 and R143a). Typical examples of the unsaturated fluorinated hydrocarbon refrigerant include R1225ye (1,2,3,3,3-pentafluoropropene), R1234yf (2,3,3,3-tetrafluoropropene), R1234ze (1,3,3,3-tetrafluoropropene) and R1234yz (1,2,3,3-tetrafluoropropene). These unsaturated fluorinated hydrocarbon refrigerants may be used singly or as a mixture of two or more thereof and, further, may be used as a mixture with the above saturated fluorinated hydrocarbon refrigerants.

In the present invention, the hydrofluorocarbon refrigerant may be also used in conjunction with other refrigerants than the hydrofluorocarbon such as a fluorine-containing ether type refrigerant and a fluorine-free type refrigerant (e.g., dimethyl ether).

The lubricating oil of the present invention is excellent in compatibility with hydrofluorocarbon refrigerants and, therefore, is particularly suited for use as a lubricating oil for a hydrofluorocarbon compression-type refrigerant circulating system.

The refrigerating apparatus of the present invention comprises a compression-type refrigerant circulating system composed at least of a compressor, a condenser, an expansion mechanism (such as an expansion valve) and an evaporator, or of a compressor, a condenser, an expansion mechanism, a drier and an evaporator as indispensable constituent parts, and preferably uses a natural-type refrigerant such as carbon dioxide and the above-described lubricating oil of the present invention.

The drier is preferably filled with a drying agent of a zeolite having a pore diameter of 3.5 Å or less. Such zeolite may be natural zeolite or synthetic zeolite.

When such a drying agent is used in the present invention, moisture in the refrigeration cycle can be efficiently removed without absorbing the refrigerant. At the same time, formation of powder due to deterioration of the drying agent can be prevented. Therefore, there is no fear of clogging of the piping and abnormal wears of sliding parts of the compressor due to powder formation, so that the refrigeration apparatus can be stably operated for a long period of time.

Further, the refrigeration apparatus of the present invention constitutes a circulating system as a cooling cycle thereof and may be a closed-type compressor of an inside high-pressure type or an inside low-pressure type in which the compressor and a motor are covered with a single cover, an open-type compressor in which a driving section of the compressor is located outside, a semi-closed-type compressor or a canned motor-type compressor.

In any of the above-described types of the compressors, it is preferred that the windings of the motor stator be comprised of a core wire (such as a magnet wire) covered with an enamel coating having a glass transition temperature of 130° C. or higher or of an enamel wire fixed with a varnish having a glass transition temperature of 50° C. or higher. The enamel coating is preferably composed of a single layer or a composite layer made of polyesterimide, polyimide, polyamide or polyamideimide. In particular, an enamel coating composed of a laminate having a lower layer having a lower glass transition temperature and an upper layer having a higher glass transition temperature has excellent water resistance, softening resistance and swelling resistance, shows high mechanical strength, rigidity and insulation property and, therefore, has a practically high utilization value.

In the refrigeration apparatus of the present invention, an insulation film used as an electrically insulating material for a motor section is preferably a crystalline plastic film having a glass transition temperature of 60° C. or higher. A crystalline plastic film having an oligomer content of 5% by mass or less is particularly preferred.

As the preferred crystalline plastic film having a glass transition temperature of 60° C. or higher, there may be mentioned films of polyether nitrile, polyethylene terephthalate, polybutylene terephthalate, polyphenylene sulfide, polyether ether ketone, polyethylene naphthalate, polyamideimide and polyimide.

The insulation film of the motor may be made of a single layer of the above crystalline plastic film or may be made of a composite film in which a film having a lower glass transition temperature is covered with a layer of a plastic having a higher glass transition temperature.

In the refrigeration apparatus of the present invention, a vibration damping rubber may be disposed inside the compressor. In this case, such a vibration damping rubber may be suitably selected from an acrylonitrile-butadiene rubber (NBR), an ethylene-propylene-diene rubber (EPDM or EPM), a hydrogenated acrylonitrile-butadiene rubber (HNBR), a silicone rubber and a fluorine-containing rubber (FKM). Particularly preferred is a rubber having a rubber expansion rate of 10% by mass or less.

Further, in the refrigeration apparatus of the present invention, various organic materials (such as sheath materials for lead wires, binding yarns, enameled wires, insulating films) may be disposed inside the compressor. In such a case, the organic material used preferably has a reduction rate in tensile strength of 20% or less.

Further, in the refrigeration apparatus of the present invention, a gasket disposed within the compressor preferably has an expansion rate of 20% or less.

Specific examples of the refrigeration apparatus of the present invention include a closed-type scroll compressor, a closed-type swing compressor, a closed-type reciprocating compressor and a closed-type rotary compressor. Closed-type compressors may be used for electric car air conditioners, air conditioners, refrigerators and water heaters.

Here, an example of a closed-type rotary compressor will be described with reference to the accompanying drawing.

FIG. 1 is a vertical cross-sectional view showing an essential part of an example of a closed-type twin rotary compressor which is a kind of a refrigeration apparatus according to the present invention. Designated as 1 is a casing in the form of a closed vessel also serving as an oil reservoir, in which a motor section and a compressor section are disposed at upper and lower parts thereof, respectively. The motor section is composed of a stator 2 and a motor rotor 3. A rotary shaft 4 is fittedly secured to the motor rotor 3. The stator 2 has a winding part 5 a core wire of which is generally covered with an enamel wire. Further, an electrically insulating film is inserted between a core part and the winding part of the stator 2. The compressor part, on the other hand, is composed of two compression chambers, i.e., an upper compression chamber 6 and a lower compression chamber 7.

In the compressor, a compressed refrigerant gas is alternately discharged from the upper and lower compression chambers 6 and 7 with a phase difference of 180 degrees. In each of the compression chambers, a cylindrical rotary piston is driven by a crank fitted therewithin and is eccentrically rotated while being maintained in point contact with a wall surface of the cylinder. A blade is urged by a spring so that a tip end of the blade is always maintained in contact with the rotary piston. Thus, the blade is provided for reciprocal movement. When the rotary piston is eccentrically rotated, the volume of one of the spaces separated by the blade is reduced so that a refrigerant gas therein is compressed. When a predetermined pressure is reached, a valve provided in a flange surface of a bearing is opened to discharge the refrigerant gas outside.

As the open-type compressor, there may be mentioned a car air conditioner. As the semi-closed-type compressor, there may be mentioned a high speed multiple cylinder compressor. As the canned motor-type compressor, there may be mentioned an ammonia compressor.

EXAMPLES

The present invention will be next described in more detail by way of examples but is not restricted to these examples in any way.

Catalyst Preparation Example 1

In a SUS316L autoclave having a volume of 2 L, 6 g of a nickel diatomaceous earth catalyst (trade name N113 manufactured by Nikki Chemical Co., Ltd.) and 300 g of isooctane were placed. The atmosphere in the autoclave was substituted with nitrogen and then with hydrogen. Then, the hydrogen pressure was adjusted to 3.0 MPaG and the temperature was raised. The autoclave was maintained at 140° C. for 30 minutes and thereafter cooled to room temperature. After the atmosphere in the autoclave was substituted with nitrogen, 10 g of acetaldehyde diethylacetal were added to the autoclave. The atmosphere in the autoclave was again substituted with nitrogen and then with hydrogen. The hydrogen pressure was adjusted to 3.0 MPaG and the temperature was raised. The autoclave was maintained at 130° C. for 30 minutes and thereafter cooled to room temperature. As a result of the temperature rise, the pressure within the autoclave increased. However, as a result of the reaction of the acetaldehyde diethylacetal, the hydrogen pressure was found to decrease. When the hydrogen pressure decreased to below 3.0 MPaG, hydrogen was supplied to maintain the hydrogen pressure therewithin at 3.0 MPaG. The autoclave was then cooled to room temperature and the pressure was released. The atmosphere in the autoclave was then substituted with nitrogen. Thereafter the pressure in the autoclave was released.

Preparation Example 1

In a 1 L separable glass flask were charged 60.5 g of isooctane, 30.0 g ($2.50\times10^{-1}$ mol) of diethylene glycol monomethyl ether and 0.296 g of boron trifluoride diethyl ether complex. Then, 216.3 g (3.00 mol) of ethyl vinyl ether were added over 3 hours and 35 minutes. Because heat was generated by the reaction, the flask was immersed in an ice water bath so that the reaction liquid was maintained at 25° C. The reaction liquid was then transferred to a 1 L separatory funnel and washed with 50 mL of a 5% by mass aqueous sodium hydroxide solution and then six times with 100 mL distilled water. Thereafter, the solvent and light fractions were removed under a reduced pressure using a rotary evaporator, thereby obtaining 235.1 g of a crude product.

The crude product had kinematic viscosities of 79.97 $mm^2/s$ at 40° C. and 9.380 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. The hydrogen pressure was adjusted to 3.0 MPaG and the temperature was raised. The autoclave was maintained at 160° C. for 3 hours and thereafter cooled to room temperature. As a result of the temperature rise, the pressure within the autoclave increased. However, as the reaction proceeded, the hydrogen pressure was found to decrease. When the hydrogen pressure decreased, hydrogen was supplied at suitable timing to maintain the hydrogen pressure therewithin at 3.0 MPaG. The atmosphere in the autoclave was then substituted with nitrogen, and the pressure in the autoclave was released. The reaction liquid was then collected and filtered to remove the catalyst.

The obtained filtrate was treated under a reduced pressure using a rotary evaporator to remove the solvent and light fractions and to obtain Base Oil 1. The yield was 88.5 g. The theoretical structure of Base Oil 1 estimated from the charged raw materials is such that, in the formula (X) shown below, (A): $R^y=CH_2CH_2$, m=2, $R^z=CH_3$; (B): $R^x=CH_2CH_3$; (A)/(B) molar ratio: (k/p)=1/11; k+p=12 (average). The calculated value of the molecular weight is 940. The carbon/oxygen molar ratio is 3.64.

[Chemical Formula 8]

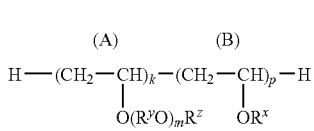

(X)

Preparation Example 2

In a 1 L separable glass flask were charged 60.5 g of isooctane, 37.1 g ($2.50\times10^{-1}$ mol) of dipropylene glycol monomethyl ether and 0.296 g of boron trifluoride diethyl ether complex. Then, 216.3 g (3.00 mol) of ethyl vinyl ether were added over 3 hours and 10 minutes. Thereafter, in the same manner as that described in Preparation Example 1, a crude product was obtained in an amount of 246.3 g. The crude product had kinematic viscosities of 114.9 $mm^2/s$ at 40° C. and 11.45 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 2 was obtained.

The yield was 89.1 g. The theoretical structure of Base Oil 1 estimated from the charged raw materials is such that, in the formula (X), (A): $R^y$=$CH(CH_3)CH_2$, m=2, $R^z$=$CH_3$, (B): $R^x$=$CH_2CH_3$; (A)/(B) molar ratio: (k/p)=1/11; k+p=12 (average). The calculated value of the molecular weight is 957. The carbon/oxygen molar ratio is 3.79.

Preparation Example 3

In a 1 L separable glass flask were charged 43 g of toluene, 6.09 g ($8.00\times10^{-2}$ mol) of 2-methoxyethanol and 0.095 g of boron trifluoride diethyl ether complex. Then, 102.1 g (1.00 mol) of methoxyethyl vinyl ether were added over 3 hours and 35 minutes. Because heat was generated by the reaction, the flask was immersed in an ice water bath so that the reaction liquid was maintained at 25° C. After completion of the reaction, the reaction liquid was transferred to a 1 L separatory funnel, to which a 10% by mass aqueous sodium hydroxide solution was added until the reaction liquid became alkaline. Thereafter, the reaction liquid was transferred to a 1 L Erlenmeyer flask, to which an ion exchange resin was added and mixed with stirring to make the liquid neutral. The resulting liquid was placed in a rotary evaporator, and the solvent and light fractions were removed under a reduced pressure, thereby obtaining 106.4 g of a crude product. The crude product had kinematic viscosities of 78.53 $mm^2/s$ at 40° C. and 12.34 $mm^2/s$ at 100° C.

Next, the autoclave containing the catalyst prepared in Catalyst Preparation Example 1 was opened and the liquid layer was removed by decantation. Then, 300 g of isooctane, 50 g of 2-methoxyethanol and 68 of the above obtained crude product were added to the autoclave. The atmosphere in the autoclave was substituted with nitrogen and then with hydrogen. The hydrogen pressure was adjusted to 3.0 MPaG and the temperature was raised. The autoclave was maintained at 160° C. for 3 hours and thereafter cooled to room temperature. As a result of the temperature rise, the pressure within the autoclave increased. However, as the reaction proceeded, the hydrogen pressure was found to decrease. When the hydrogen pressure decreased, hydrogen was supplied at suitable timing to maintain the hydrogen pressure therewithin at 3.0 MPaG. The atmosphere in the autoclave was then substituted with nitrogen, and the pressure in the autoclave was released. The reaction liquid was then collected and filtered to remove the catalyst.

The obtained filtrate was treated under a reduced pressure using a rotary evaporator to remove the solvent and light fractions and to obtain Base Oil 3. The yield was 57.3 g. The theoretical structure of Base Oil 3 estimated from the charged raw materials is such that, in the formula (X), (A): $R^y$=$CH_2CH_2$, m=1, $R^z$=$CH_3$; (B): p=0; k=12.5 (average). The calculated value of the molecular weight is 1,277. The carbon/oxygen molar ratio is 2.50.

Preparation Example 4

In a 1 L separable glass flask were charged 60.5 g of isooctane, 51.6 g ($2.50\times10^{-1}$ mol) of tripropylene glycol monomethyl ether and 0.296 g of boron trifluoride diethyl ether complex. Then, 198.4 g (2.75 mol) of ethyl vinyl ether were added over 3 hours and 10 minutes. Thereafter, in the same manner as that described in Preparation Example 1, a crude product was obtained in an amount of 241.7 g. The crude product had kinematic viscosities of 83.13 $mm^2/s$ at 40° C. and 9.755 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 4 was obtained.

The yield was 92.6 g. The theoretical structure of Base Oil 4 estimated from the charged raw materials is such that, in the formula (X), (A): $R^y$=$CH(CH_3)CH_2$, m=3, $R^z$=$CH_3$, (B): $R^x$=$CH_2CH_3$; (A)/(B) molar ratio: (k/p)=1/10; k+p=11 (average). The calculated value of the molecular weight is 954. The carbon/oxygen molar ratio is 3.71.

Preparation Example 5

In a 1 L separable glass flask were charged 60.5 g of isooctane, 25.0 g ($1.69\times10^{-1}$ mol) of dipropylene glycol monomethyl ether and 0.200 g of boron trifluoride diethyl ether complex. Then, 133.8 g (1.86 mol) of ethyl vinyl ether were added over 3 hours. Thereafter, in the same manner as that described in Preparation Example 1, a crude product was obtained in an amount of 151.8 g. The crude product had kinematic viscosities of 86.24 $mm^2/s$ at 40° C. and 9.620 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 5 was obtained.

The yield was 92.4 g. The theoretical structure of Base Oil 5 estimated from the charged raw materials is such that, in the formula (X), (A): $R^y$=$CH(CH_3)CH_2$, m=2, $R^z$=$CH_3$, (B): $R^x$=$CH_2CH_3$; (A)/(B) molar ratio: (k/p)=1/10; k+p=11 (average). The calculated value of the molecular weight is 896. The carbon/oxygen molar ratio is 3.77.

Preparation Example 6

In a 1 L separable glass flask were charged 60.5 g of isooctane, 25.0 g ($1.52\times10^{-1}$ mol) of triethylene glycol monomethyl ether and 0.180 g of boron trifluoride diethyl ether complex. Then, 158.0 g (2.19 mol) of ethyl vinyl ether were added over 2 hours and 25 minutes. Thereafter, in the same manner as that described in Preparation Example 1, a crude product was obtained in an amount of 174.7 g. The crude product had kinematic viscosities of 81.98 $mm^2/s$ at 40° C. and 9.679 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 6 was obtained.

The yield was 93.0 g. The theoretical structure of Base Oil 6 estimated from the charged raw materials is such that, in the formula (X), (A): $R^y$=$CH_2CH_2$, m=3, $R^z$=$CH_3$, (B): $R^x$=$CH_2CH_3$; (A)/(B) molar ratio: (k/p)=1/13.4; k+p=14.4

(average). The calculated value of the molecular weight is 1,157. The carbon/oxygen molar ratio is 3.60.

Preparation Example 7

In a 1 L separable glass flask were charged 60.5 g of isooctane, 30.0 g ($2.50\times10^{-1}$ mol) of diethylene glycol monomethyl ether and 0.296 g of boron trifluoride diethyl ether complex. Then, 225.34 g (3.13 mol) of ethyl vinyl ether were added over 3 hours and 5 minutes. Thereafter, in the same manner as that described in Preparation Example 1, a crude product was obtained in an amount of 243.75 g. The crude product had kinematic viscosities of 98.12 $mm^2/s$ at 40° C. and 10.57 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 7 was obtained.

The yield was 93.1 g. The theoretical structure of Base Oil 7 estimated from the charged raw materials is such that, in the formula (X), (A): $R^y=CH_2CH_2$, m=2, $R^z=CH_3$, (B): $R^x=CH_2CH_3$; (A)/(B) molar ratio: (k/p)=1/11.5; k+p=12.5 (average). The calculated value of the molecular weight is 976. The carbon/oxygen molar ratio is 3.66.

Preparation Example 8

In a 1 L separable glass flask were charged 52.3 g of isooctane, 87.0 g ($1.98\times10^{-1}$ mol) of polypropylene glycol monomethyl ether (average molecular weight: about 440) and 0.237 g of boron trifluoride diethyl ether complex. Then, 150.67 g (2.09 mol) of ethyl vinyl ether were added over 5 hours and 20 minutes. Because heat was generated during the reaction, the flask was immersed in an ice water bath to maintain the reaction liquid at 30° C. Thereafter, in the same manner as that described in Preparation Example 1, a crude product was obtained in an amount of 230.66 g. The crude product had kinematic viscosities of 71.18 $mm^2/s$ at 40° C. and 10.12 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 8 was obtained.

The yield was 92.6 g. The theoretical structure of Base Oil 8 estimated from the charged raw materials is such that, in the formula (X), (A): $R^y=CH(CH_3)CH_2$, m=7.0, $R^z=CH_3$, (B): $R^x=CH_2CH_3$; (A)/(B) molar ratio: (k/p)=1/9.5; k+p=10.5 (average). The calculated value of the molecular weight is 1,185. The carbon/oxygen molar ratio is 3.54.

Preparation Example 9

In a 1 L separable glass flask were charged 83.0 g of isooctane, 96.15 g ($3.00\times10^{-1}$ mol) of polypropylene glycol monomethyl ether (average molecular weight: about 320) and 0.355 g of boron trifluoride diethyl ether complex. Then, 281.27 g (3.90 mol) of ethyl vinyl ether were added over 2 hours and 55 minutes. Thereafter, in the same manner as that described in Preparation Example 1, a crude product was obtained in an amount of 369.95 g. The crude product had kinematic viscosities of 133.6 $mm^2/s$ at 40° C. and 14.10 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 9 was obtained.

The yield was 89.2 g. The theoretical structure of Base Oil 9 estimated from the charged raw materials is such that, in the formula (X), (A): $R^y=CH(CH_3)CH_2$, m=5.0, $R^z=CH_3$, (B): $R^x=CH_2CH_3$; (A)/(B) molar ratio: (k/p)=1/12.0; k+p=13.0 (average). The calculated value of the molecular weight is 1,214. The carbon/oxygen molar ratio is 3.67.

Preparation Example 10

In a 1 L separable glass flask were charged 88.1 g of isooctane, 96.05 g ($3.00\times10^{-1}$ mol) of polypropylene glycol monomethyl ether (average molecular weight: about 320) and 0.357 g of boron trifluoride diethyl ether complex. Then, 303.13 g (4.20 mol) of ethyl vinyl ether were added over 2 hours and 57 minutes. Thereafter, in the same manner as that described in Preparation Example 1, a crude product was obtained in an amount of 387.92 g. The crude product had kinematic viscosities of 158.7 $mm^2/s$ at 40° C. and 15.82 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 10 was obtained.

The yield was 94.7 g. The theoretical structure of Base Oil 10 estimated from the charged raw materials is such that, in the formula (X), (A): $R^y=CH(CH_3)CH_2$, m=5.0, $R^z=CH_3$, (B): $R^x=CH_2CH_3$; (A)/(B) molar ratio: (k/p)=1/13.0; k+p=14.0 (average). The calculated value of the molecular weight is 1,324. The carbon/oxygen molar ratio is 3.68.

Preparation Example 11

In a 1 L separable glass flask were charged 51.5 g of isooctane, 33.90 g ($1.54\times10^{-1}$ mol) of polypropylene glycol monomethyl ether (average molecular weight: about 220) and 0.182 g of boron trifluoride diethyl ether complex. Then, 200.00 g (2.77 mol) of ethyl vinyl ether were added over 4 hours and 55 minutes. Thereafter, in the same manner as that described in Preparation Example 1, a crude product was obtained in an amount of 230.66 g. The crude product had kinematic viscosities of 278.6 $mm^2/s$ at 40° C. and 21.00 $mm^2/s$ at 100° C.

Next, the autoclave containing the catalyst prepared in Catalyst Preparation Example 1 was opened and the liquid layer was removed by decantation. Then, 300 g of isooctane and 100 g of the above obtained crude product were added to the autoclave. The atmosphere in the autoclave was substituted with nitrogen and then with hydrogen. Thereafter, in the same manner as that described in Preparation Example 1, Base Oil 11 was obtained.

The yield was 93.4 g. The theoretical structure of Base Oil 11 estimated from the charged raw materials is such that, in the formula (X), (A): $R^y=CH(CH_3)CH_2$, m=3.3, $R^z=CH_3$, (B): $R^x=CH_2CH_3$; (A)/(B) molar ratio: (k/p)=1/17.0; k+p=18.0 (average). The calculated value of the molecular weight is 1,475. The carbon/oxygen molar ratio is 3.80.

Examples 1 to 11 and Comparative Examples 1 to 3

Base Oils 1 to 11 obtained in Preparation Examples 1 to 11, respectively, were used in Examples 1 to 11. In Comparative Example 1, a mixture of 50% by mass of a commercially available polyalkylene glycol (PAG oil) (Trade name: Daphne Hermetic Oil NF, manufactured by Idemitsu Kosan Co., Ltd.) and 50% by mass of a commercially available polyalkylene glycol (PAG oil) (Trade name: Daphne Hermetic Oil PZ100S, manufactured by Idemitsu Kosan Co., Ltd.) was used (commercially available oil 1). In Comparative Example 2, a commercially available polyalkylene glycol (PAG oil) (Trade name: Daphne Hermetic Oil PZ100S, manufactured by Idemitsu Kosan Co., Ltd.) was used (commercially available oil 2). In Comparative Example 3, a commercially available polyvinyl ether (PVE oil) (Trade name: Daphne Hermetic Oil FVC68D, manufactured by Idemitsu Kosan Co., Ltd.) was used (commercially available oil 3).

Each of the oils was measured for its kinematic viscosities (at 40° C. and 100° C.), viscosity index and compatibility. The results are shown in Table 1.

These properties were measured and evaluated according to the following methods.

(1) Kinematic Viscosity

The kinematic viscosities at 100° C. and 40° C. of the sample oils were measured in accordance with JIS K2283.

(2) Viscosity Index

The viscosity index was determined from the above obtained kinematic viscosity in accordance with JIS K2283.

(3) Compatibility with Refrigerant

Using R410A as a refrigerant, each of the sample oils was measured for its compatibility with the refrigerant in accordance with JIS K2211, "Test Method for Compatibility" of "Refrigerant Machine Oil". More specifically, the sample oil was mixed with the refrigerant in amounts of 5, 10, 15, 20, 25 and 30% by mass based on the refrigerant. Each of the mixtures was gradually heated from −50° C. to 70° C. to determine the temperature at which the mixture separated or became opaque (phase separation temperature on higher side). In Table 1, "70<" means that no separation or opaqueness is observed at 70° C.

TABLE 1

| | Lubricating Oil | Compatibility Oil 5 % by mass | Oil 10 % by mass | Oil 15 % by mass | Oil 20 % by mass | Oil 25 % by mass | Oil 30 % by mass | Kinematic Viscosity ($mm^2/s$) 40° C. | 100° C. | Viscosity Index |
|---|---|---|---|---|---|---|---|---|---|---|
| Example 1 | Base Oil 1 | 51.1 | 50.9 | 52.4 | 55.2 | 61.0 | 70< | 65.27 | 8.758 | 107 |
| Example 2 | Base Oil 2 | 44.6 | 43.2 | 44.8 | 48.0 | 50.2 | 70< | 102.5 | 11.48 | 99 |
| Example 3 | Base Oil 3 | 55.6 | 56.3 | 57.4 | 60.9 | 70< | 70< | 69.99 | 11.47 | 158 |
| Example 4 | Base Oil 4 | 44.1 | 43.0 | 44.5 | 46.8 | 51.3 | 70< | 71.51 | 9.433 | 109 |
| Example 5 | Base Oil 5 | 46.6 | 45.7 | 48.4 | 50.5 | 53.8 | 70< | 73.17 | 9.352 | 104 |
| Example 6 | Base Oil 6 | 47.8 | 47.1 | 48.7 | 50.3 | 53.4 | 70< | 69.91 | 9.351 | 111 |
| Example 7 | Base Oil 7 | 49.5 | 48.1 | 50.3 | 52.3 | 53.5 | 70< | 80.08 | 9.868 | 102 |
| Example 8 | Base Oil 8 | 32.9 | 31.1 | 33.5 | 36.7 | 40.5 | 46.8 | 60.34 | 9.518 | 140 |
| Example 9 | Base Oil 9 | 30.7 | 28.1 | 30.5 | 34.0 | 36.0 | 40.9 | 111.4 | 13.36 | 117 |
| Example 10 | Base Oil 10 | 21.7 | 18.1 | 21.7 | 23.6 | 32.1 | 35.2 | 159.3 | 16.63 | 111 |
| Example 11 | Base Oil 11 | 25.7 | 19.4 | 22.4 | 25.5 | 27.8 | 31.5 | 233.8 | 19.97 | 98 |
| Comparative Example 1 | Commercially Available Oil 1 | 8.0 | 4.0 | 7.3 | 10.4 | 12.6 | 23.3 | 70.64 | 14.42 | 215 |
| Comparative Example 2 | Commercially Available Oil 2 | Separation | Separation | Separation | Cloud | −10 | −4.4 | 106.5 | 20.47 | 218 |
| Comparative Example 3 | Commercially Available Oil 3 | 46.2 | 43.2 | 44.6 | 47.6 | 49.6 | 52.3 | 66.61 | 8.057 | 84 |

From Table 1, it will be seen that the base oils of the present invention have better compatibility as compared with the PAG oils of Comparative Examples 1 and 2 and higher viscosity index as compared with the PEV oil of Comparative Example 3.

Accordingly, the base oils of the present invention of Examples 1 to 9, which have kinematic viscosities of about 10 $mm^2/s$ at 100° C., are particularly suited as a lubricating oil for car air conditioners. The base oils of the present invention of Examples 10 and 11, which have kinematic viscosities of about 20 $mm^2/s$ at 100° C., are particularly suited as a lubricating oil for showcases, automatic vending machines and water heaters.

INDUSTRIAL APPLICABILITY

The lubricating oil of the present invention, which has excellent compatibility with a hydrofluorocarbon refrigerant used as a cooling medium, may be used as a lubricating oil for a compression-type refrigerator which uses a hydrofluorocarbon refrigerant.

Further, the lubricating oil of the present invention may be utilized, for the purpose of improving the compatibility with a refrigerant, in the form of a mixture with another lubricating oil for a compression-type refrigerator such as an ester compound, a polycarbonate compound, a mineral oil, an alkylbenzene or a poly-α-olefin.

Further, the refrigeration apparatus according to the present invention which uses the lubricating oil of the present invention may be effectively used as a compression type refrigerator using a hydrofluorocarbon refrigerant, such as a refrigeration system, an air conditioning system, an air conditioning system for cars, a showcase, a water heater, an automatic vending machine or a refrigerator.

The invention claimed is:

1. A method of lubricating a compression-type refrigerator with a lubricating oil, wherein said compression-type refrigerator comprises a hydrofluorocarbon refrigerant and said lubricating oil comprises a polyvinyl ether-based compound having a structure represented by the general formula (I)

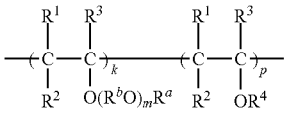

(I)

wherein $R^1$, $R^2$ and $R^3$ each represent a hydrogen atom or a $C_1$ to $C_8$ hydrocarbon group and may be the same as or different from each other; $R^b$ represents a divalent $C_2$ to $C_4$ hydrocarbon group; $R^a$ represents a hydrogen atom, a $C_1$ to $C_{20}$ aliphatic or alicyclic hydrocarbon group, a $C_1$ to $C_{20}$ aromatic group which may have a substituent, a $C_2$ to $C_{20}$ acyl group or a $C_2$ to $C_{50}$ oxygen-containing hydrocarbon group; $R^4$ represents a $C_1$ to $C_{10}$ hydrocarbon group; with the proviso that when there are a plurality of $R^a$'s, a plurality of $R^b$'s and a plurality of $R^4$'s, the $R^a$'s, $R^b$'s and $R^4$'s may each be the same as or different from each other; m is a number of 1 to 50 on average; k is a number of 1 to 50 on average; and p is a number of 2 to 50 on average; with the provisos that when there are a plurality of k's and a plurality of p's, the distribution may each be block or random, and that when there are a plurality of $R^bO$'s, the $R^bO$'s may be the same as or different from each other.

2. The method of lubricating a compression-type refrigerator using a hydrofluorocarbon refrigerant as defined in claim 1, wherein m in the general formula (I) is two or more.

3. The method of lubricating a compression-type refrigerator using a hydrofluorocarbon refrigerant as defined in claim 1, wherein the polyvinyl ether-based compound has a carbon/oxygen molar ratio of 4.0 or less.

4. The method of lubricating a compression-type refrigerator using a hydrofluorocarbon refrigerant as defined in claim 1, wherein the lubricating oil has a kinematic viscosity at 100° C. of 1 to 50 $mm^2/s$.

5. The method of lubricating a compression-type refrigerator using a hydrofluorocarbon refrigerant as defined in claim 1, wherein the lubricating oil has a viscosity index of 80 or more.

6. The method of lubricating a compression-type refrigerator using a hydrofluorocarbon refrigerant as defined in claim 1, wherein the hydrofluorocarbon refrigerant is one or a combination of a saturated fluorinated hydrocarbon and a fluorinated hydrocarbon having a double bond.

7. The method of lubricating a compression-type refrigerator using a hydrofluorocarbon refrigerant as defined in claim 1, wherein the hydrofluorocarbon refrigerant is a mixed refrigerant of R404A, R407A, R407c, R407E, R410A or R507A.

8. A refrigeration apparatus comprising a compressor, a condenser, an expansion mechanism and an evaporator, wherein a hydrofluorocarbon refrigerant and a lubricating oil are circulated in said apparatus, said lubricating oil lubricating oil comprising a polyvinyl ether-based compound having a structure represented by the general formula (I)

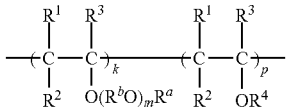

(I)

wherein $R^1$, $R^2$ and $R^3$ each represent a hydrogen atom or a $C_1$ to $C_8$ hydrocarbon group and may be the same as or different from each other; $R^b$ represents a divalent $C_2$ to $C_4$ hydrocarbon group; $R^a$ represents a hydrogen atom, a $C_1$ to $C_{20}$ aliphatic or alicyclic hydrocarbon group, a $C_1$ to $C_{20}$ aromatic group which may have a substituent, a $C_2$ to $C_{20}$ acyl group or a $C_2$ to $C_{50}$ oxygen-containing hydrocarbon group; $R^4$ represents a $C_1$ to $C_{10}$ hydrocarbon group; with the proviso that when there are a plurality of $R^a$'s, a plurality of $R^b$'s and a plurality of $R^4$'s, the $R^a$'s, $R^b$'s and $R^4$'s may each be the same as or different from each other; m is a number of 1 to 50 on average; k is a number of 1 to 50 on average; and p is a number of 2 to 50 on average; with the provisos that when there are a plurality of k's and a plurality of p's, the distribution may each be block or random, and that when there are a plurality of $R^bO$'s, the $R^bO$'s may be the same as or different from each other.

* * * * *